US006921294B2

(12) United States Patent
Devine et al.

(10) Patent No.: US 6,921,294 B2
(45) **Date of Patent: *Jul. 26, 2005**

(54) UNIVERSAL WIRE HARNESS FOR DETECTORS

(75) Inventors: Mark A. Devine, Shorewood, IL (US); Michael A. Swieboda, Naperville, IL (US); Andrew J. Ivanecky, Aurora, IL (US)

(73) Assignee: BRK Brands, Inc., Aurora, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/799,211

(22) Filed: Mar. 12, 2004

(65) Prior Publication Data

US 2004/0171307 A1 Sep. 2, 2004

Related U.S. Application Data

(63) Continuation of application No. 10/612,317, filed on Jul. 2, 2003, now Pat. No. 6,840,812, which is a continuation of application No. 09/886,907, filed on Jun. 21, 2001, now Pat. No. 6,641,433.

(51) Int. Cl.[7] ..... H01R 25/00
(52) U.S. Cl. ..... 439/638
(58) Field of Search ..... 439/172, 505, 439/638, 651, 678

(56) References Cited

U.S. PATENT DOCUMENTS

| | | | |
|---|---|---|---|
| 4,091,363 | A | 5/1978 | Siegel et al. |
| 4,239,319 | A | 12/1980 | Gladd et al. |
| 4,538,877 | A | 9/1985 | Novis |
| 4,897,052 | A | 1/1990 | Priest et al. |
| 5,064,389 | A | 11/1991 | Klein et al. |
| 5,281,147 | A | 1/1994 | Hughes |
| 5,295,845 | A | 3/1994 | Changxing |
| 5,417,593 | A | 5/1995 | Suzuki et al. |
| 5,518,416 | A | 5/1996 | Kantner et al. |
| 5,848,907 | A | 12/1998 | Chen |
| 5,855,064 | A | 1/1999 | Chang |
| 5,871,376 | A | 2/1999 | Tsai et al. |
| 5,899,773 | A | 5/1999 | Cheng |
| 6,039,608 | A | 3/2000 | Amero et al. |
| 6,302,717 | B1 | 10/2001 | Cheung |
| 6,371,815 | B1 | 4/2002 | Wetzel et al. |
| 6,435,916 | B1 | 8/2002 | Amberg et al. |
| 6,461,192 | B1 | 10/2002 | Kwoka |

FOREIGN PATENT DOCUMENTS

| | | |
|---|---|---|
| DE | 16 40 555 | 10/1970 |
| DE | 16 40 555 B2 | 10/1970 |
| DE | 39 10 514 C2 | 10/1990 |
| DE | 39 10514 A1 | 10/1990 |
| DE | G 92 07 496.0 U1 | 10/1992 |
| DE | 202 07 462 U1 | 9/2002 |
| FR | 642.086 | 10/1927 |
| FR | 1.445.657 | 5/1965 |
| GB | 1 594 094 | 7/1981 |
| GB | 2 337 640 A | 11/1999 |
| JP | 07094219 A | 4/1995 |
| JP | 2000164306 A | 6/2000 |

*Primary Examiner*—Khiem Nguyen
(74) *Attorney, Agent, or Firm*—Welsh & Katz Ltd.

(57) ABSTRACT

An electrical unit, such as a fire or gas detector, carries a three conductor plug for receipt of energy, AC hot, and neutral, as well as for coupling to a bidirectional signaling line. A multiple conductor adapter makes it possible to couple the plug to a plurality of incompatible, previously installed sockets. The adapter can be fully contained in a single housing. Alternately, it can include a housing for some of the conductors with the remainder carried on a cable which extends from the housing.

22 Claims, 3 Drawing Sheets

UNIVERSAL WIRE HARNESS FOR DETECTORS

This application is a continuation of application Ser. No. 10/612,317 filed Jul. 2, 2003 now U.S. Pat. No. 6,840,812 which is a divisional of application Ser. No. 09/886,907 filed Jun. 21, 2001 now U.S. Pat. No. 6,641,433 entitled "Universal Wire Harness for Detectors".

FIELD OF THE INVENTION

The invention pertains to AC-powered ambient condition detectors. More particularly, the invention pertains to connectors and adapters for coupling such detectors to existing AC sockets.

BACKGROUND OF THE INVENTION

Fire detectors which can be battery powered or powered with utility supplied AC current are known. Battery powered detectors have become very popular as they are self-contained and can easily be installed almost anywhere. They are usually stand alone devices which do not interact with other similar detectors in the same region or installation.

Detectors which are coupled together by a communications line provide an alternate to stand alone, battery powered units. Such systems usually incorporate a three conductor cable. Two conductors (AC hot and neutral) provide electrical energy to power the detectors. A third conductor is used for signaling between detectors.

The cables terminate in three conductor sockets. A matching plug couples each detector to the cable.

Over a period of time, different socket/plug combinations have been used by manufacturers. In fact, there have been instances where a later model detector would not be compatible with previously installed sockets of the same manufacturer.

The problem of older, previously installed sockets impedes the replacement of older detectors with more current models. Where AC powered, or, interconnected detectors are installed in residences or small businesses, there may not be persons available who can safely remove the existing sockets and replace them with sockets compatible with more current models from the same or different manufacturers.

There is an on-going need to facilitate replacement of older AC powered, or, interconnected detectors with more current models. It would be most desirable if current detectors could be coupled to existing sockets without requiring any rewiring.

SUMMARY OF THE INVENTION

A connection adapter which facilitates coupling electrical units, such as fire or gas detectors, heat detectors or the like, to electrical cables includes a non-conductive housing. The housing carries a first set of electrical conductors and a second set of electrical conductors. The number of conductors is the same for both sets.

The first set exhibits an electro-mechanical plug profile for engagement with socket elements of an existing connector. The second set exhibits an electro-mechanical socket profile for engagement with a second plug carried by a respective electrical unit.

In a disclosed embodiment, the electrical units are fire or gas detectors which are to receive electrical energy, from a remote source, via a respective electrical plug. One form of electrical energy is utility supplied AC.

The adapter interfaces between the electrical plug of the respective detector and an existing power distribution cable which has an existing socket with a profile that is unlike the plug. Where the cable carries AC, for example, the adapter converts the configuration of the existing AC socket to that of the plug which exhibits two contacts, AC hot and neutral for example.

In one form, the adapter has a single two sided housing. One side is a plug for mating with the existing AC connector at the cable. The other side is a socket for mating with the detector's plug.

In another embodiment, the adapter has a socket for engagement with the detector's plug. A plurality of conductors extends from the adapter. The conductors engage individual contacts of the socket carried by the cable to couple electrical energy form the cable to the respective detectors.

In yet another embodiment, the installed socket includes a third, signaling conductor. The adapter mates with the installed three conductor socket and with a three conductor plug carried by the electrical unit.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
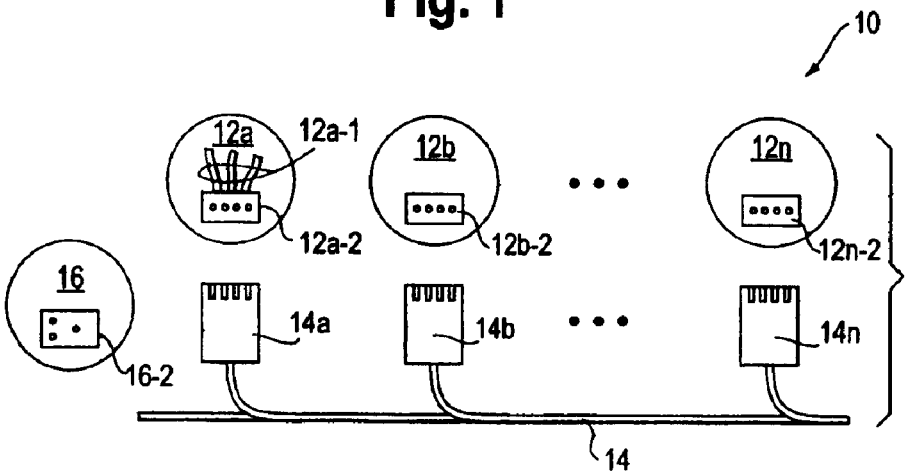
FIG. 1 is a block diagram of a system illustrating a problem solved by the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 of ambient condition detectors 12*a,b,c,* . . . *n*. These detectors are all coupled to a multiple conductor cable, such as a two conductor AC utility line 14. The cable 14 can also include a third conductor for inter-detector signaling purposes as would be known to those of skill in the art.

Each of the detectors, such as 12*a*, has a plurality of internal conductors 12*a*-1 ( indicated in phantom) which extends therefrom and which is terminated by a plug 12*a*-2 of a predetermined configuration. Each of the plugs 12*a*-2 . . . 12*n*-2 is compatible with and is intended to engage a corresponding socket, such as the sockets 14*a,b,c,d* . . . *n* carried on and coupled to the cable 14.

In known installations, sockets 14*a,b,c,d* . . . *n* mate with corresponding plugs 12*a*-2 . . . 12*n*-2 to couple power to the respective detector and to provide intra-detector signaling. Such configurations provide convenience in installation and safety by isolating the power contacts from direct access by installer or maintenance personnel.

The above described system 10 is limited in that a replacement detector 16 which has a plug 16-2 with a different configuration can not be installed to replace detector 12*a* without altering or replacing socket 14*a*. This exposes the AC power lines and requires skill to be carried out safely.

Figure 2:
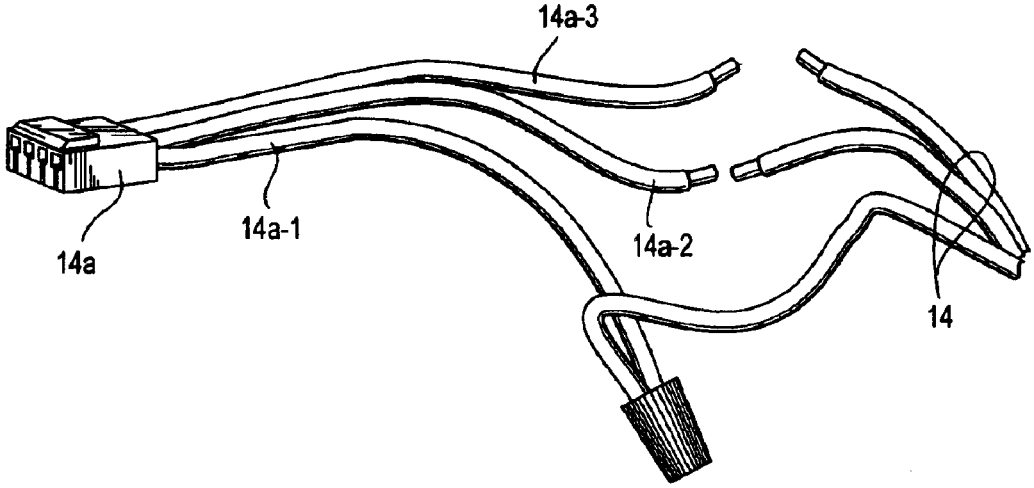
FIG. 2 is a schematic diagram illustrating exemplary wiring of a type found in systems as in FIG. 1.

FIG. 2 illustrates socket 14*a* with three conductors 14*a*-1,-2,-3 coupled by wire nuts to multi-conductor cable 14. Changing socket 14*a* so as to be compatible with plug 16-2 requires removing the respective wire nuts and installing a socket compatible with plug 16-2.

Figure 3:
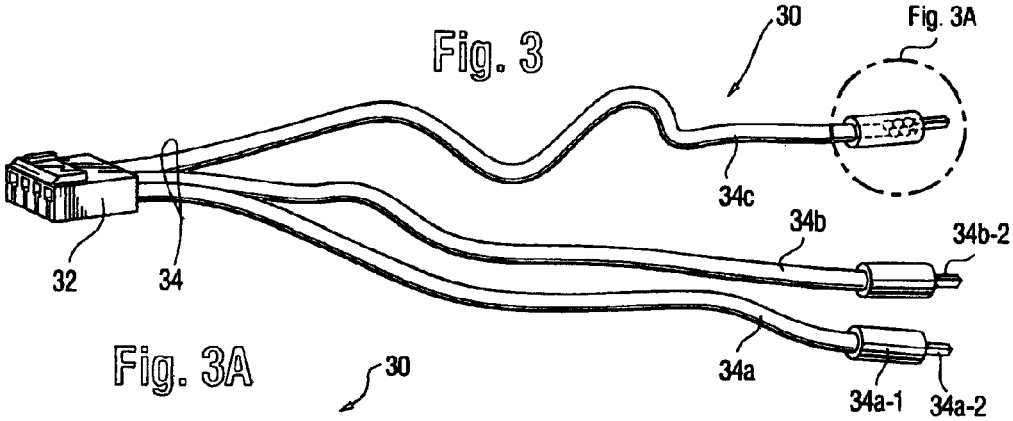
FIG. 3 is a diagram of one embodiment of the present invention.
Figure 3A:
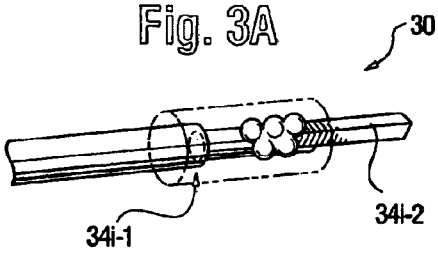

FIG. 3 illustrates an adapter 30 which can be used to couple plug 16-2 to socket 14*a* safely and without any need to alter or replace the existing sockets 12*a,b,c,d . . . n*. The adapter 30 includes a socket 32 which is compatible with plug 16-2. A plurality of conductors 34 extends from socket 32.

Each of the conductors 34*a,b,c* has a free end which carries an insulator, such as 34*a*-1. Each insulator covers a respective pin 34*a*-2 which is compatible with a respective socket-element in a socket such as socket 14*a*. The conductors 34*a,b,c* of adapter 30 are inserted into socket elements in socket 14*a*. Those pins thus engage the respective socket elements safely and conveniently. The plug 16-2 of replacement detector 16 can be coupled to adapter socket 32 so as to receive power and signals off of cable 14.

Figure 4A:
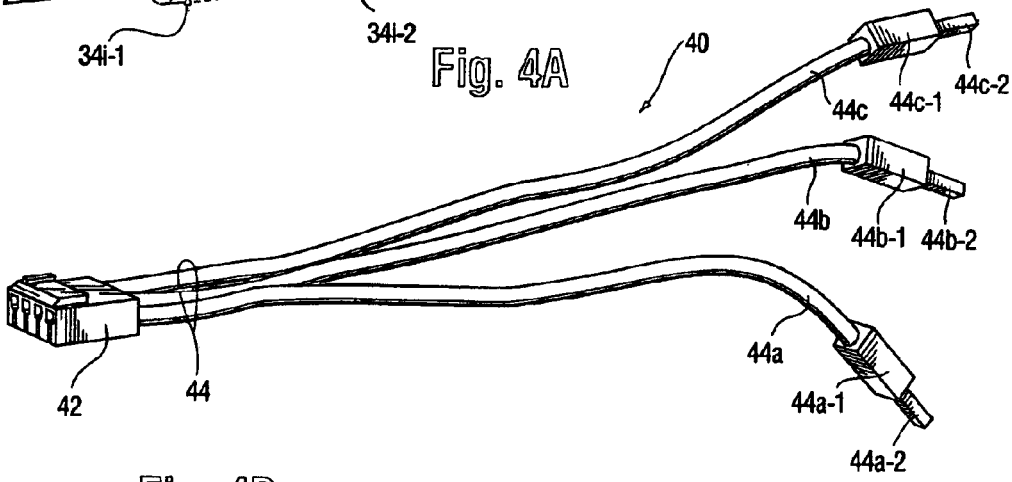
FIGS. 4A, B, and C, taken together illustrate another embodiment of the invention.

FIG. 4A illustrates an alternate adapter system 40. Adapter system 40 has a socket 42 which is compatible with plug 16-2. Conductors 44 extend from socket 42. A positioning, or locating element, such as 44*a*-1 is carried adjacent a free end of each conductor. Each conductor carries at the free end a respective pin, such as pin 44*a*-2.

Figure 4B:
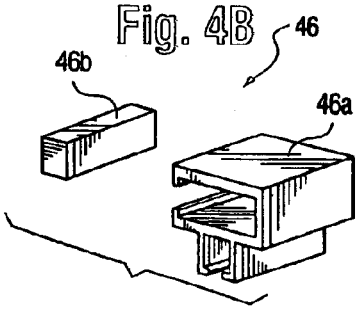
Figure 4C:
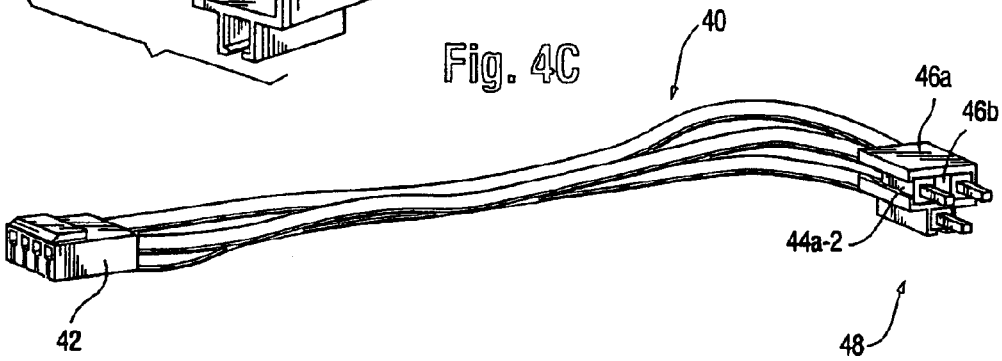

FIG. 4B illustrates a configurable shell, or housing 46. Housing 46 includes a holder 46*a* and a spacer 46*b*. Positioning elements 44*a*-1,*b*-1,*c*-1 can be inserted into and locked in holder 46*a*, along with spacer 46*b* with an arrangement which is compatible with a respective socket such as socket 14*a* as illustrated in FIG. 4C. The pins 44*a*-2, *b*-2 and *c*-2 extend from holder 46*a* forming a plug 48.

The plug 48 is compatible with socket 14*a* while the socket 42 is compatible with plug 16-2. The detector 16 can now be safely and conveniently coupled to cable 14.

The adapter 40 can readily be configured by a home owner or other installer prior to any engagement with the respective socket such as socket 14*a*. Adapter 40 can be used with a variety of different sockets merely by rearranging the location of spacer 46*b* and the relative positions of the pins 44*a*-23, *b*-2 and *c*-2.

Figure 5:
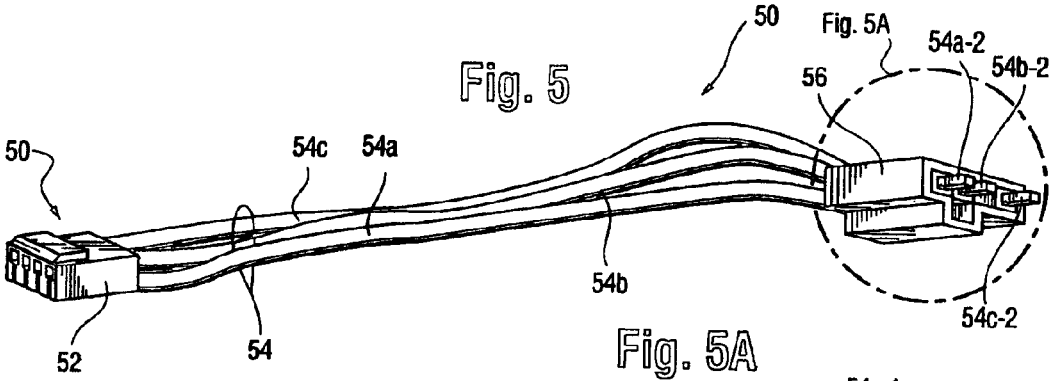
FIG. 5 illustrates yet another embodiment of the invention.
Figure 5A:
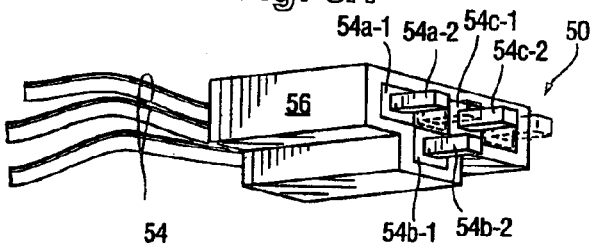

FIG. 5 illustrates an adapter system 50 which incorporates a socket 52 which is compatible with plug 16-2. Conductors 54 extend from socket 52.

A housing 56 carries a plurality of spacing elements such as the elements 54*a*-1, *b*-1 and *c*-1 from which extend plug pins 54*a*-2, *b*-2, and *c*-2 (comparable to the positioning elements 44*a*-1, *b*-1, and *c*-1 and pins 44*a*-2, *b*-2 and *c*-2, best seen in FIG. 4A.) In the system 50, the housing 56 exhibits five locations into which the spacing elements 54*a*-1, *b*-1 and *c*-1 can be moved for purposes of configuring the pins 54*a*-2, *b*-2 and *c*-2 in a way which is compatible with a respective previously installed socket such as one of the sockets 14*a, b, . . . n*.

By rearranging the connector pins 54*a*-2, *b*-2 and *c*-2, a user or installer can readily configure the adapter system 50 for connection with one or more pre-existing sockets. The configuration process takes place off-line with no connection to the existing sockets or cable 14 thus providing for a user's convenience and safety.

Figure 6A:
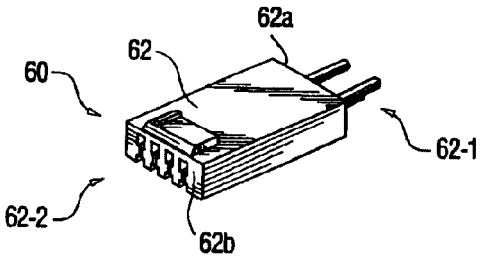
FIGS. 6A, B and C each illustrate two different views of an adapter which embodies the present invention.
Figures 1, 6A:
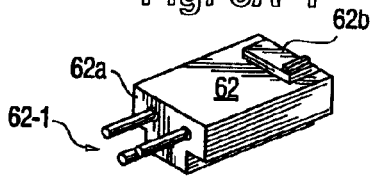

FIGS. 6A, B and C each illustrate two different views of an integrally formed adapter in accordance with the present invention. In FIG. 6A, an adapter 60 has a housing 62 with first and second ends 62*a,b*. The end 62*a* carries a plug 62-1 configured to mate with an existing socket, such as socket 14*n* of cable 14. End 62*b* carries a socket 62-2 configured to mate with plug 16-2.

Using adapter 60, new detectors can be installed in existing systems quickly and safely. An adapter, such as adapter 60, is especially convenient, as no discrete wires need to be inserted. All wiring between each plug 62-1, end 62*a* is coupled to an appropriate plug 62-2, end 62*b* by conductors internal to housing 62. Coupling between respective socket 62-2 and plug 62-1 can be implemented using discrete conductors or printed wiring. Adapter 60 need only be plugged into socket 14*a* and to plug 16-2 to install detector 16.

Figure 6B:
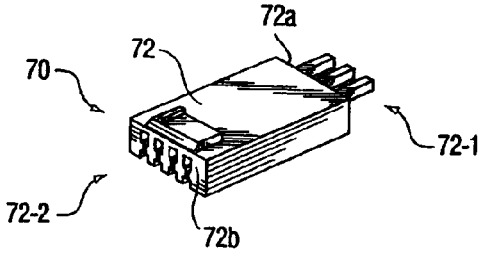
Figures 1, 6B:
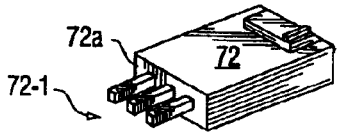
Figure 6C:
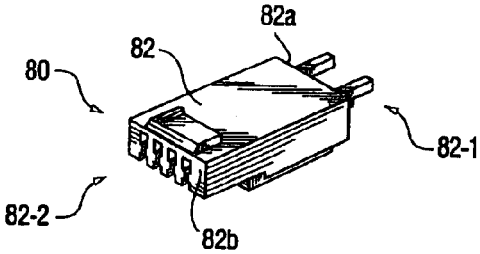
Figures 1, 6C:
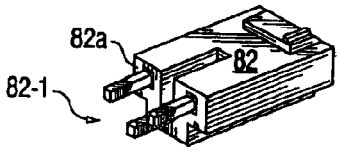

FIGS. 6B and 6C illustrate alternate forms of adapters 70 and 80. Each carries a plug on a respective end 72*a*, 82*a* whose elements are connected to a socket carried on a respective end 72*b*, 82*b*. Socket elements are connected to respective plug elements within a respective housing 72, 82.

Other configurations are possible as adapters 60, 70 and 80 are exemplary only. All such configurations come within the spirit and scope of the present invention. One such variation is to combine movable pins or plug elements, as in FIG. 5 in the integrally formed configurations of FIG. 6A, B or C. Hence, one adapter 60 can be used with a variety of pre-existing socket configurations.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An adapter for coupling an existing connector of a multi-wire interconnect system to a different ambient condition detector than the one for which the existing connector was designed. the adapter comprising:

a non-conductive housing which carries a first set of electrical conductors and a second set of electrical conductors where the number of the second set of conductors at least equals the number of the first set of conductors, where members of the first set exhibit an electro-mechanical plug-type profile for engagement with socket elements of the existing connector; and where members of the second set comprise an electro-mechanical socket-type profile for engagement with a second plug carried by the ambient condition detector, where the existing connector and the second plug are incompatible and are not mutually engageable, where the first set of electrical conductors comprises a plurality of rigid connecting prongs which extend in a first direction, exposed relative to the housing, so as to engageable with the existing connector.

2. An adapter as in claim 1 where the first and second sets each comprise three conductors.

3. An adapter as in claim 1 where the first and second sets extend substantially parallel to one another and are joined by one of discrete conductors, or, printed wiring.

4. An adapter as in claim 1 where the socket-type profile of the second set is axially oriented relative to the housing.

5. An adapter as in claim 3 where the first and second sets of conductors each comprise three conductors.

6. An adapter as in claim 1 where at least one of the conductors delivers power to a respective ambient condition detector and another conductor provides electrical signaling to/from the respective detector.

7. An adapter as in claim 6 where some of the conductors in the housing are movable between first and second positions in the housing.

8. An adapter as in claim 3 where the prongs extend, at least in part, from the housing.

9. An adapter as in claim 1 where the first and second sets of conductors are joined by one of discrete conductors or printed wiring.

10. An adapter for coupling an existing connector of a multi-wire interconnect system to a different ambient condition detector than the one for which the existing connector was designed, the adapter comprising:

a non-conductive housing coupled to a first set of electrical contacts and a second set of contacts where the number of the second set at least equals the number of the first set of contacts, where members of the first set exhibit an electro-mechanical plug-type profile for engagement with socket elements of the existing connector; and where members of the second set exhibit an electro-mechanical socket-type profile for engagement with a second plug carried by the ambient condition detector where the existing connector and the second plug are incompatible and are not mutually engageable, where the first set of electrical contacts includes a plurality of rigid conducting prongs.

11. An adapter as in claim 10 where the contacts of the first and second sets include at least one of a power conductor and a signaling conductor.

12. An adapter as in claim 10 which includes at least a second housing to which is coupled third and fourth spaced apart contacts, the second and fourth contacts being substantially identical, the first and third contacts being different.

13. An adapter system comprising;

a housing having first and second sides;

a plurality of conductors carried by the housing;

first and second pluralities of contacts electrically coupled to respective conductors with one of the first contacts, and one of the second contacts coupling communications signals between one of a local source and a remote destination, or a local destination and a remote source and with another of the first contacts, and another of the second contacts coupling electrical energy from a remote source to a local destination with the mechanical configuration of the first plurality of contacts comprising a plug configuration instable with one of a plurality of existing interconnected sockets and with the mechanical configuration of the second plurality of contacts comprising a socket configuration rentable with a plug of a local electrical unit where the plug of the electrical unit is not matable with the existing socket such that the conductors in the housing couple electrical energy in one direction to the socket of the housing and couple communication signals bidirectionally between the plug and socket thereof.

14. An adapter system as in claim 13 where the conductors comprise printed wiring.

15. An apparatus comprising:

an ambient condition detector, the detector carries a connector of a predetermined configuration having at least one of a multi-conductor electrical plug, or a multi-conductor electrical socket;

at least one adapter having a plug and a socket with one of the plug or the socket configured to engage the connector of the detector with the other of the plug or the socket configured to engage a power/signaling connector of a power/signaling cable, the connector of the detector is incompatible with the power/signaling connector.

16. An apparatus as in claim 15 with the adapter having a housing which carries the plug and socket.

17. An apparatus as in claim 16 where the plug and socket are electrically interconnected by at least one of discrete conductors, or primed wiring.

18. An apparatus as in claim 16 which includes at least a second, different adapter having a plug and a socket with one of the plug or the socket configured to engage the detector and with the other of the plug or the socket configured to engage a different power/signaling connector of a power/signaling cabler, the connector of the detector is incompatible with the different power/signaling connector.

19. An apparatus as in claim 15 where the detector is selected from a group which includes a fire detector, a gas detector, a heat detector, and a combined fire/gas detector.

20. An apparatus as in claim 19 where one conductor of the detector connector comprises a power input and another comprises a bi-directional signaling port, and, where the plug of the adapter includes at least two plug-type contacts and the socket thereof includes at least two socket-type contacts with one contact of each type engageable with the power input and the other contact of each type engageable with the signaling port.

21. An apparatus as in claim 20 where the adapter includes a housing, the plug and socket are electrically interconnected by printed wiring, and where the plug and socket extend substantially parallel to one another.

22. An apparatus as in claim 21 where the printed wiring is carried within the housing.

* * * * *